US006012870A

United States Patent [19]

Dillingham

[11] Patent Number: 6,012,870

[45] Date of Patent: Jan. 11, 2000

[54] APPARATUS AND METHOD FOR TRANSPORTING HEATED PAVEMENT REPAIR MATERIALS

[75] Inventor: Harold W. Dillingham, Jacksonville, Tex.

[73] Assignee: H.D. Industries, Inc., Jacksonville, Tex.

[21] Appl. No.: 09/027,841

[22] Filed: Feb. 23, 1998

[51] Int. Cl.[7] ..... E01C 23/11

[52] U.S. Cl. ..... 404/79; 404/101

[58] Field of Search ..... 404/101, 72, 92, 404/79, 77

[56] References Cited

U.S. PATENT DOCUMENTS

| | | | |
|---|---|---|---|
| 4,695,186 | 9/1987 | King | 404/101 |
| 4,944,632 | 7/1990 | Dillingham | 404/111 |
| 5,419,654 | 5/1995 | Kleiger | 404/101 |
| 5,447,388 | 9/1995 | Rouse | 404/72 |
| 5,765,963 | 6/1998 | Roberts | 404/92 |

*Primary Examiner*—Thomas B. Will
*Assistant Examiner*—Raymond W Addie
*Attorney, Agent, or Firm*—Charles D. Gunter, Jr.

[57] ABSTRACT

A portable apparatus is shown for transporting heated pavement repair materials. The apparatus has a heat chamber with an enclosed interior. A mixing chamber is contained within the enclosed interior of the heat chamber and has an inlet for receiving pavement repair materials and an outlet for discharging mixed and heated product. Either a dry radiant heat source or a liquid heat transfer source can be utilized to heat the mixing chamber. The apparatus is used to dispense a pavement repair material which is aggregate free, which does not require compaction and which is self-leveling.

6 Claims, 7 Drawing Sheets

APPARATUS AND METHOD FOR TRANSPORTING HEATED PAVEMENT REPAIR MATERIALS

BACKGROUND OF THE INVENTION

1. Field of the Invention

The present invention relates generally to truck and/or trailer mounted portable devices and methods for dispensing pavement repair materials.

2. Description of the Prior Art

In the past, as many as three vehicles were sometimes needed to repair openings and potholes in asphalt, concrete and other roadway surfaces. One vehicle provided an air compressor for use with various pneumatic repair tools which were used to dress the hole, crack or cavity to be filled. Another vehicle contained liquid asphalt tack material which would be sprayed into the dressed cavity, and a third vehicle would deliver asphalt mix material to the cavity. The asphalt would then be packed, compacted and leveled by hand to complete the repair.

U.S. Pat. No. 4,196,827, issued Apr. 8, 1980, entitled "Portable Machine For Transporting Heated Asphalt Products For Use In Repairing Asphalt Pavement" shows a portable machine which was designed to incorporate all phases of the pavement repair into one mobile unit. The machine has a hopper for transporting asphalt mix, and a reservoir below the hopper having a heat source. The reservoir contained liquid asphalt tack material. The heat source is used to heat the liquid tack material, and the tack material is used to heat the asphalt mix in the hopper by heat transfer. Asphalt tack material is also dispensed from the tack material tank by means of spray equipment connected to a discharge valve on the rear of the truck.

In spite of being less expensive to operate in terms of material and labor, the previously described device possessed several different disadvantages. Many of these disadvantages related to the type of repair material utilized and the fact that multi-component materials were required to do each job. Because multiple component materials were required for each patch job, the equipment used for transporting such components was complicated and often limited in versatility. For example, the liquid asphalt tank carried on the unit was suitable for road oils and cutbacks but was not well suited for use with asphaltic cements. Also, in the case of the device described in the '827 patent, the liquid asphalt tank was not suited for use with asphalt emulsions, because the volatile contents of the emulsions would be driven off and dry out the materials.

U.S. Pat. No. 4,944,632, issued Jul. 31, 1990, and assigned to the assignee of the present invention showed a portable unit with a separate tack oil tank which was provided with its own heat source and which was designed to prevent phase separation of the tack oil materials. While this apparatus solved the problem of tack oil phase separation, it was still designed to be employed in a multi-component repair system.

The present invention has as its object to provide a portable apparatus for dispensing a new type of pavement repair material which eliminates many of the shortcomings present in the prior art devices and methods.

Another object is to provide an improved pavement repair process utilizing a class of repair material which eliminates the need for more complicated multi-component asphaltic repair materials, as well as the need for complicated tank, heating and valving arrangements.

Another object of the invention is to provide a apparatus for use in such a method which is simple in design and economical to manufacture.

SUMMARY OF THE INVENTION

The portable apparatus of the invention is used to transport heated pavement repair materials for use in repairing roadways. The apparatus includes a heat chamber with an enclosed interior. A mixing chamber is contained within the enclosed interior of the heat chamber. The mixing chamber has an inlet for receiving pavement repair materials and an outlet for discharging mixed and heated product. Selectable and diverse heating sources are located within the heat chamber for heating the mixing chamber. The selectable and diverse heating sources include both a dry, radiant heat source and a liquid heat transfer source.

Preferably, the dry, radiant heat source is at least one burner fired retort tube located in the heat chamber and at least partly surrounding the mixing chamber. The liquid heat transfer source can be a heat transfer oil located in the heat chamber and at least partly surrounding the mixing chamber, the heat transfer oil being heated by the heat transferred from the burner fired retort tube.

In a preferred embodiment of the invention, the mixing chamber is generally cylindrically shaped and has a hydraulically powered mixing shaft centrally located therein. The hydraulically powered mixing shaft extends along a central horizontal axis of the mixing chamber and has a plurality of mixing paddle arms which extend outwardly from the shaft generally perpendicular thereto. Each paddle arm terminates in a paddle head which forms a V-shaped surface generally normal to the axis of the paddle arm.

The choice of the heat source for heating the mixing chamber is made based upon the application temperature of the pavement repair material being utilized. The new type repair materials which are preferred for use in the present method have an application temperature in the range from about 150 to 210° C. Once heated and mixed, these materials can be dispensed from the mixing chamber through the outlet thereof without first applying a tack oil. The new materials also do not generally require mixing stone aggregate with an asphaltic binder in the mixing chamber. No compaction of the pavement repair material is generally necessary and the material is self-leveling.

Additional objects, features and advantages will be apparent in the written description which follows.

DETAILED DESCRIPTION OF THE INVENTION

Figure 1:
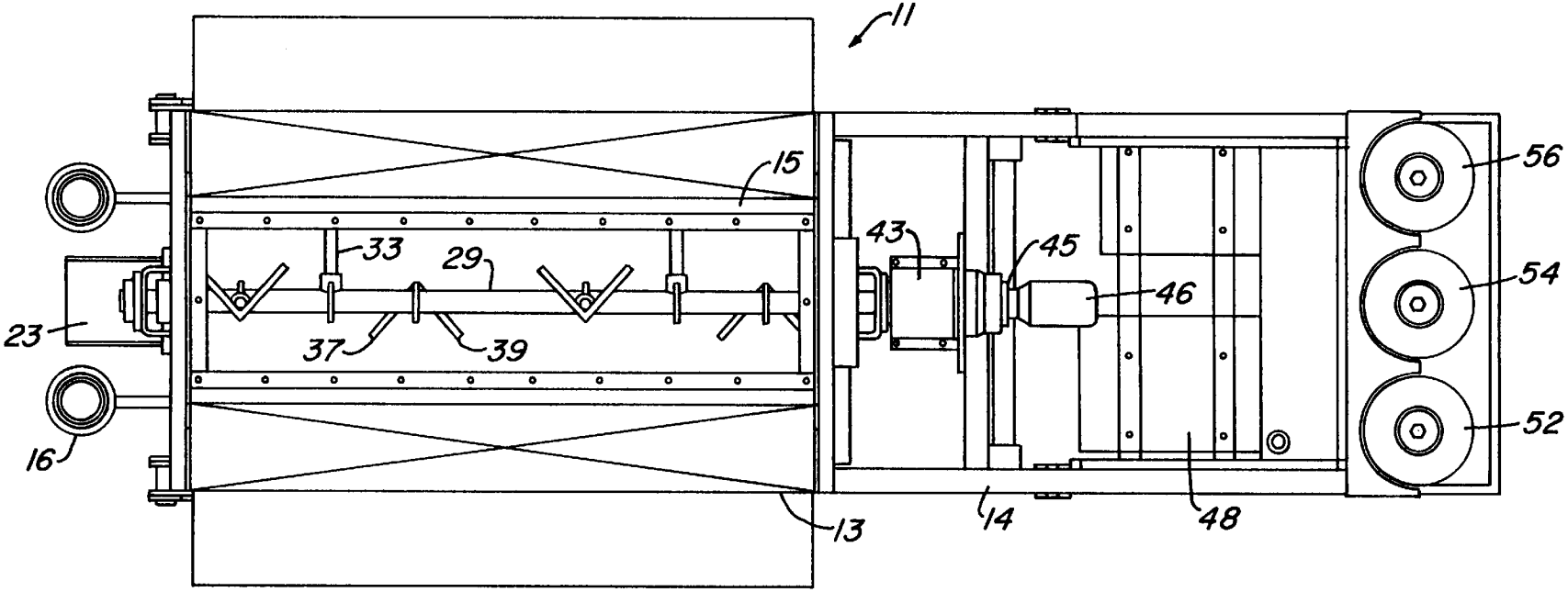
FIG. 1 is a top view of the apparatus of the invention with the doors to the heat chamber removed for ease of illustration.

Turning to FIG. 1, there is shown a portable device for transporting pavement repair materials of the invention designated generally as 11. The apparatus 11 includes a body 13 which is generally rectangular, as viewed in FIG. 1. The additional components of the apparatus 11 are mounted upon a skid 14 which is adapted to be mounted upon the bed of a truck, or upon a trailer which would be towed by a vehicle or other transport means. The truck or trailer would serve as a portable base for transporting the body 13 and skid to a repair site for repairing a pothole in an asphalt or concrete pavement. A pair of running lights 16, 18 are mounted at the rear of the body 13.

Figure 2:
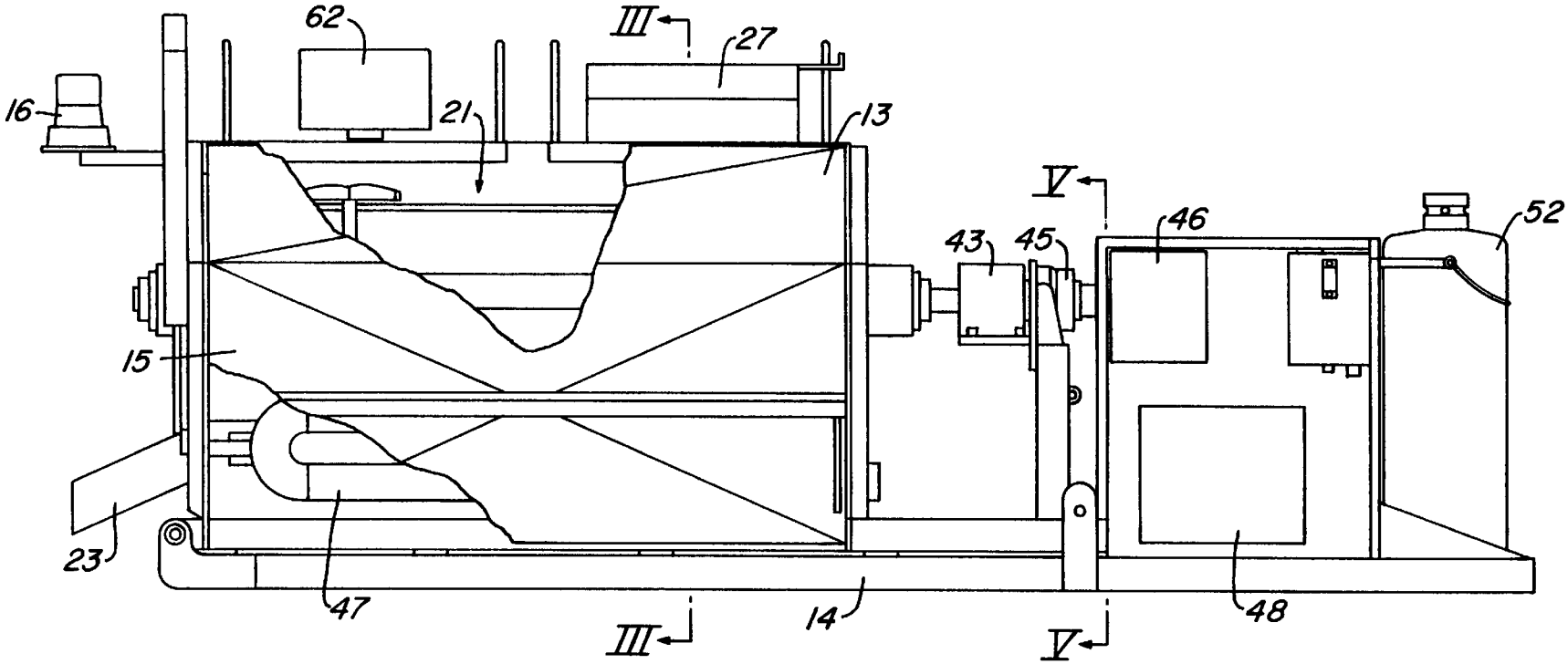
FIG. 2 is a side view of the apparatus of FIG. 1 with portions of the sidewall thereof broken away.
Figure 3:
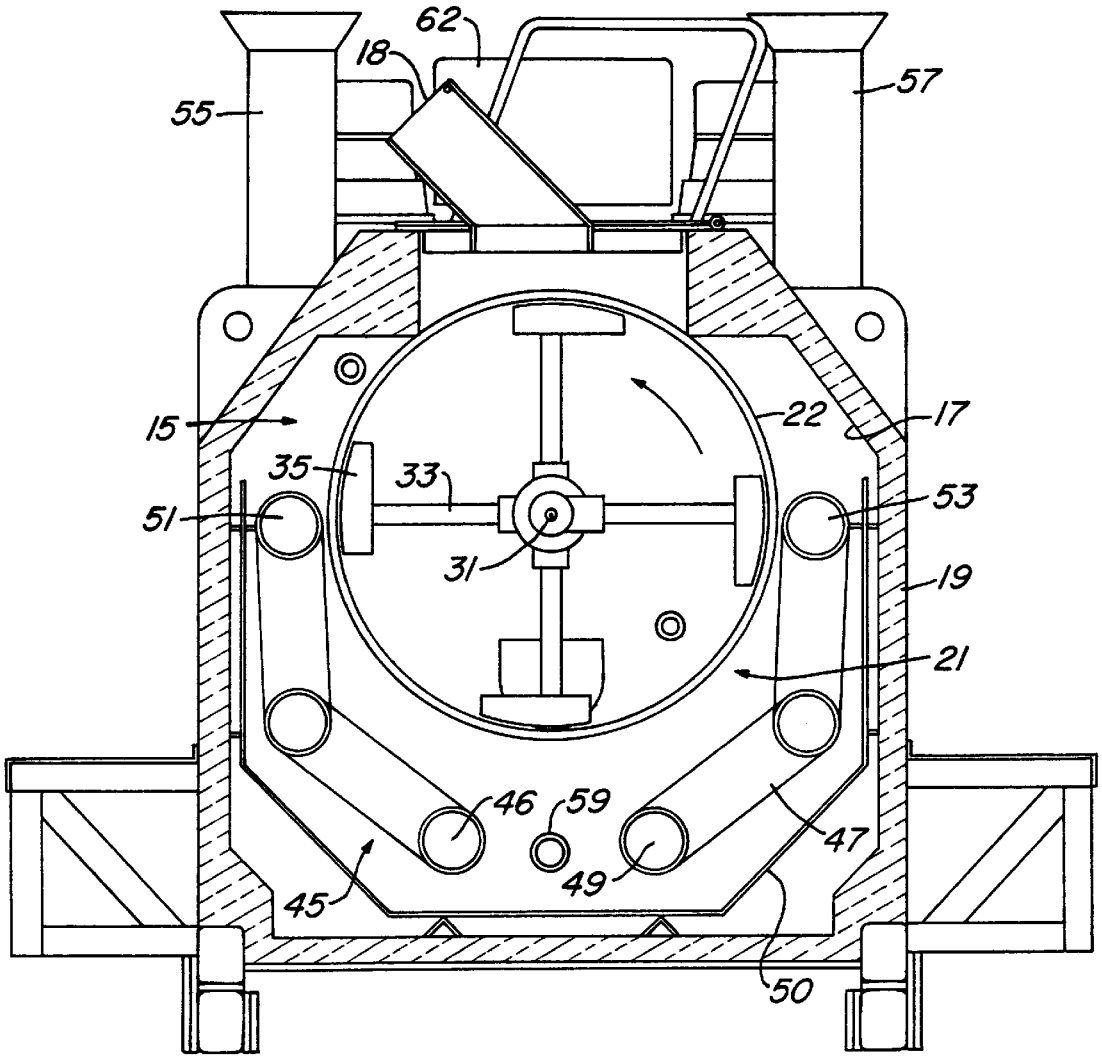
FIG. 3 is a simplified, cross-sectional view taken along lines III—III in FIG. 2.

As best seen in FIGS. 1–3, the portable apparatus 11 includes a heat chamber 15 having an enclosed interior 17 and a fill port 90 for receiving a heat transfer oil. As best seen in FIG. 3, a layer of insulating material 19 generally surrounds the enclosed interior 17 with the exception of the area adjacent the fill port 90. The insulating material can be refractory, or any material commercially available for this intended purpose and capable of insulating for temperatures in the range of about 150–210 degrees C.

Figure 5:
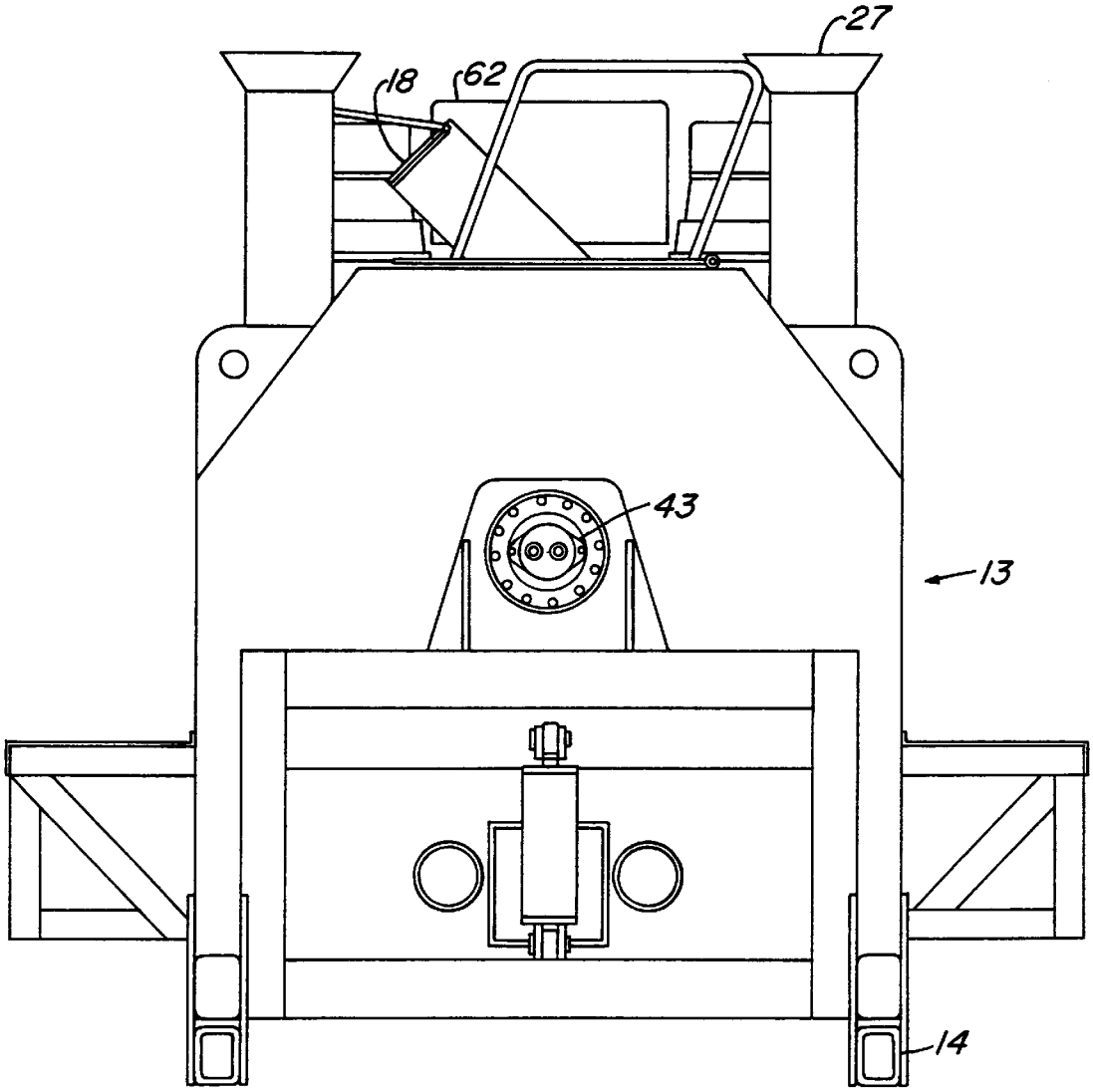
FIG. 5 is a view taken along lines V—V in FIG. 2.
Figure 6:
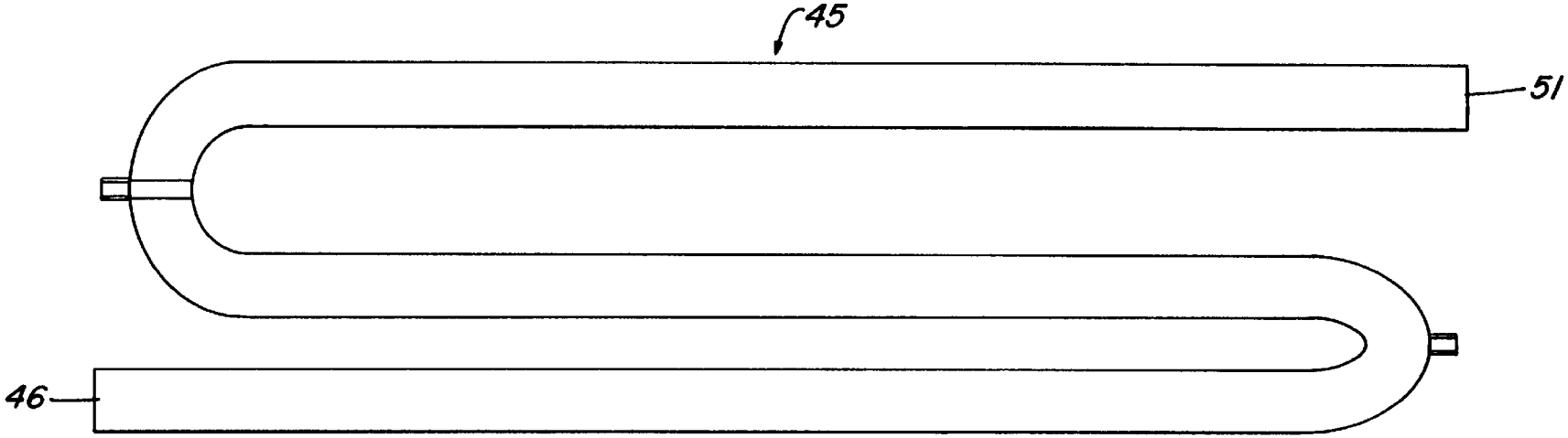
FIG. 6 is top, plan view of one of the burner retort tubes used to supply heat within the heat chamber of the apparatus.

A generally cylindrical mixing chamber 21 is supported in stationary fashion within the heat chamber 15 and has an inlet (27 in FIG. 3 and 5) or fill chute and an outlet which communicates with the discharge chute 23 (FIG. 2) of the device. The main inlet 27 receives the new pavement repair feed stock, as will be more fully described. The mixing chamber thus has an inlet for receiving pavement repair materials and an outlet for discharging mixed and heated product. The mixing chamber exterior surface 22 can be coated with a black paint or carbon black containing pigment to facilitate the absorption of heat.

Figure 4:
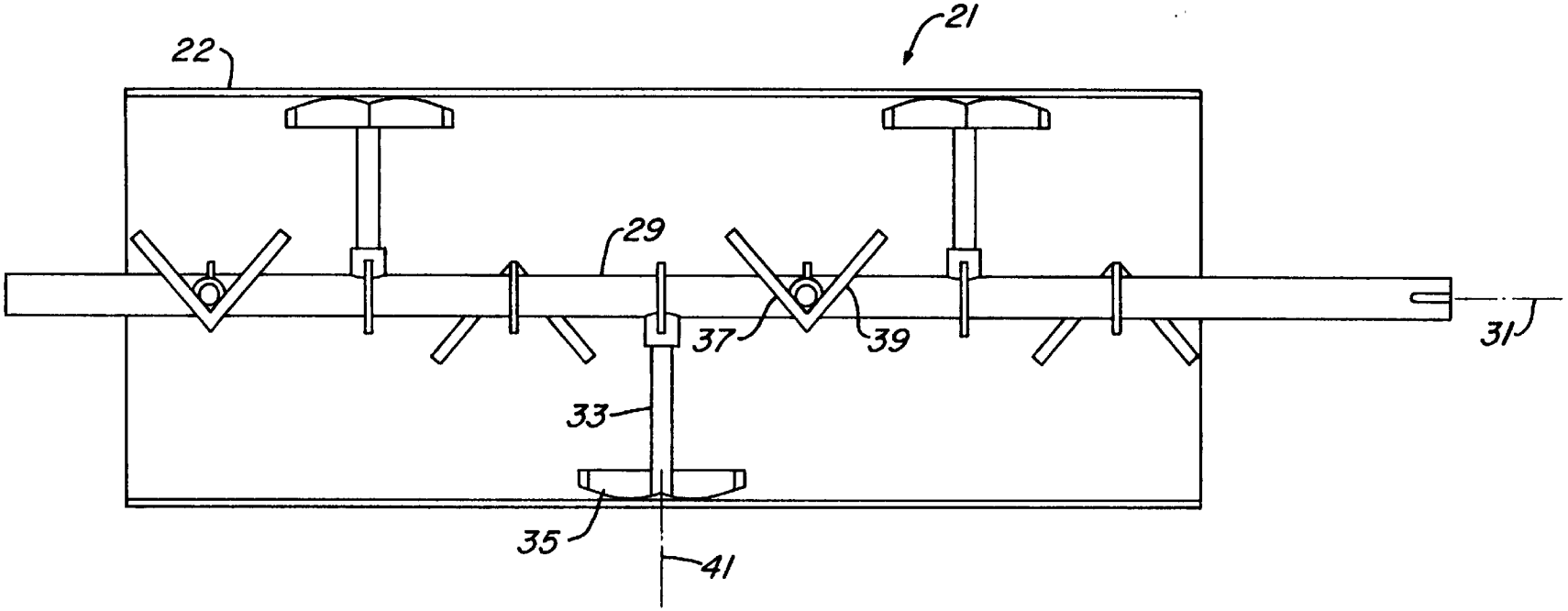
FIG. 4 is a side, isolated view of the mixing shaft located within the mixing chamber of the apparatus of the invention.

The mixing chamber 21 is shown in isolated fashion in FIG. 4. The stationary, generally cylindrically shaped chamber has a hydraulically powered mixing shaft 29 centrally located therein along a horizontal axis 31. The hydraulically powered mixing shaft has a plurality of mixing paddle arms 33 (in this case 7 arms) which extend outwardly from the shaft 29 generally perpendicular thereto and are generally equidistantly spaced along the shaft. Each paddle arm 33 terminates in a paddle head 35 which, as shown in FIG. 4, forms a V-shaped surface with sides 37, 39 generally normal to the axis 41 of the paddle arm 33. The mixing shaft is of the gear type and is driven through a gear reduction box 43 and hydraulic output shaft 91, the gear box having an approximately gear ratio of 5.29 to 1.0. The torque rating capacity is approximately 3.189 foot/pounds. The hydraulic motor 93 used to drive the shaft is a 22 cubic inch, 6 gpm motor rated to operate at 2,000 psi. The hydraulic system is independently powdered by a 14 horsepower commercially available diesel engine 48 (FIG. 1).

A selectable and diverse heating source is located within the heat chamber 15 for heating the mixing chamber. The selectable and diverse heating sources include both a dry, radiant source and a liquid heat transfer source.

The dry, radiant heat source is preferably a burner fired retort tube located within the heat chamber 15 and at least partly surrounding the mixing chamber. In the embodiment of FIG. 3, a pair of burner fired retort tubes 45, 47 are located within the interior of the heat chamber 15. Each retort tube includes an inlet 46, 49 and an outlet 51, 53 which is routed to the vertical exhaust stacks 55, 57 mounted on the exterior of the apparatus. Each of the retort tubes 45, 47 is equipped with a commercially available 2,000,000 BTU retort tube propane, diesel or natural gas burner. The fuel source shown in FIGS. 1 and 2 comprises a plurality of propane bottles 52, 54, 56 mounted on the skid 14. The burners are thermostatically controlled and regulated at 10 psi. The ignition system for the burners is a 12 volt DC source with electronic igniters. The system can also be equipped with a shut-off system on loss of flame or excessively high temperatures. A metallic heat shield 50 is located below the retort tubes 45,47 and generally encloses the retort tubes within the heat chamber, focusing radiant heat in the direction of the mixing chamber 21.

Figure 7:
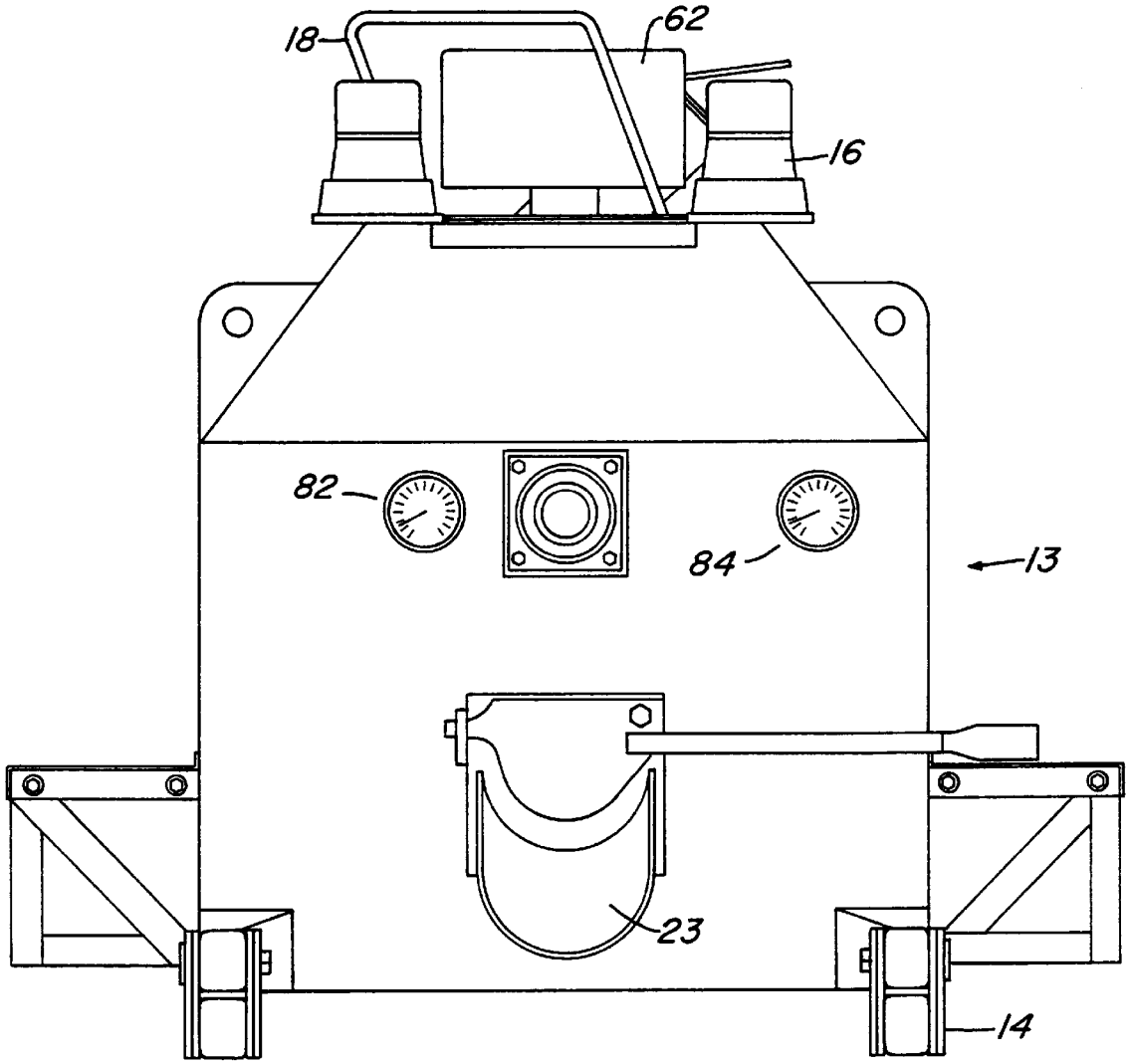
FIG. 7 is an end view of the apparatus of FIG. 2 showing the discharge chute thereof.

In addition to the retort tube heaters, the apparatus also features a 220 volt, 54.75 kw electric immersion heater 59. Electricity used to power the electric heater 59 is supplied from a 220 volt stationary electric outlet or by a 6,000 watt on board generator. Commercially available temperature gages (82, 84 in FIG. 7) are used to constantly monitor the temperature of the heat chamber and the mixer chamber.

The liquid heat transfer source can be provided by optionally filling the enclosed interior 17 of the heat chamber thru fill port 18 with a heat transfer oil whereby the heat transfer oil is heated by heat transferred from the burner fired retort tubes 45, 47 and/or by the electric heater 59. A circulating pump (62 in FIG. 2) of conventional design can be used to circulate the heat transfer oil within the enclosed interior of the heat chamber to prevent stratification of the oil within the chamber. Thus, depending upon the pavement repair material being mixed in the mixing chamber 21, an operator can elect to employ merely dry, radiant heat obtained from the retort tubes 45, 47 in an otherwise empty heat chamber interior, or the operator can at least partly fill the chamber with heat transfer oil and thereby utilize a liquid heat transfer source to heat the mixing chamber.

The apparatus of the invention also utilizes a new class of pavement repair materials. These materials are commercially available as "ROADPATCH", "ROADFLEX" and "HOTCRETE" from Roadtechs, Inc., 2323 Commerce Center Drive, Rockville, Va. The commercial specifications for each product are described briefly below:

ROADPATCH Materials Test Specifications

Technical Data

| | |
|---|---|
| Color | Black or concrete colored |
| Form | Solid |
| Specific Gravity | 2.0 |
| Application Temperature | 150–200 degrees Centigrade |
| Maximum Safe Heating Temperature | 210 degrees Centigrade |
| Surface Applications | All concrete and asphalt surfaces |
| Application Thickness | 75 mm plus |
| Curing Time | 10–60 min., depending on ambient air temp. |
| Shelf Life | Unlimited |
| Packaging | 3-ply silicon lined paper bags (50 lb.) |
| Flash Point | 250 degrees Centigrade |

ROADPATCH is a hot poured repair material with a 10–14% bitumen content containing polymers and grated fillers which produce an impermeable, voidless mass solid at ambient temperatures. The material is formulated to be utilized as a one repair material on both concrete and asphalt surfaces, including bridge decks. It is primarily intended to be utilized for asphalt repairs but can be utilized for concrete repairs as well. Surface preparation is minimal. Once the material has set up, it forms an impermeable seal to the adjacent material that is impervious to water and chemical intrusion. The material is self-leveling and requires no compaction to remain in place. The natural adhesive properties of the material ensure that it will adhere to the repair area without any type of preliminary tack coat for asphalt repairs. The material can be re-heated and applied with no adverse results and minimal cure time is required.

ROADFLEX Material Testing Methods

Technical Data

| | |
|---|---|
| Color | Black or concrete colored |
| Form | Solid |
| Specific Gravity | 1.8 |
| Application Temperature | 150–200 degrees Centigrade |
| Maximum Safe Heating Temperature | 210 degrees Centigrade |
| Surface Applications | All concrete and asphalt surfaces |
| Application Thickness | 10 mm plus |
| Curing Time | 10–60 min., depending on ambient air temp. |
| Shelf Life | Unlimited |
| Packaging | 3-ply silicon lined paper bags (50 lb. capacity) |
| Flash Point | 250 degrees Centigrade |

ROADFLEX is a hot poured repair material with a 20–25% bitumen content containing polymers and grated fillers that produces an impermeable, voidless mass solid at ambient temperatures. It is formulated to be utilized as a one repair material on both concrete and asphalt surfaces, including bridge decks. The ROADFLEX material has the ability to be utilized over movement joints such as expansion joints in concrete, reflective cracking in concrete and asphalt, etc.

HOTCRETE Material Testing Specifications

Technical Data

| | |
|---|---|
| Color | Gray (concrete colored) |
| Form | Powder until heated and applied |
| Specific Gravity | 2.0 |
| Application Temperature | 180–210 degrees Centigrade |
| Maximum Safe Heating Temperature | 220 degrees Centigrade |
| Surface Applications | All concrete surfaces, including bridge decks |
| Application Thickness | 8–10 mm plus |
| Curing Time | 10–20 min., depending on ambient air temp. |
| Shelf Life | Unlimited |
| Packaging | polypropylene bags (50 lbs.) |
| Flash Point | 220 degrees Centigrade |

HOTCRETE is a hot poured polymer modified hydrocarbon resin binder with grated fillers. It produces an impermeable, voidless mass that is solid at ambient temperatures. It is formulated to be utilized as a one repair material on concrete surfaces, including bridge decks. It can be utilized over movement joints such as expansion joints in concrete. It is recommended that a concrete primer be utilized over the damaged area prior to applying HOTCRETE. The primer hinders the intrusion of water into the repair from below and enhances the adhesion properties of the material.

These materials include an asphaltic binder, as did the prior art materials, but also include a synthetic, polymeric component. The pavement repair materials used in the method of the invention do not require a separate aggregate stone mixing step, do not require a compaction step, and are self-leveling. Yet, the materials are compatible with the asphalt or concrete pavements and stand up to demanding conditions of even heavily travelled interstate highways and city streets.

In operation, the asphaltic/polymeric binder material selected for the intended application can be added directly to the mixing chamber of the device through the material-loading chute (27 in FIG. 2) at the top of the unit. The material is allowed to heat adequately with constant agitation, the intended application temperature being between about 150 to 210 ° C., preferably about 165–195° C. The temperature is controlled to ensure that the material is never heated above about 210° C.

The pothole, crack, or other road surface imperfection is then prepared by cleaning the area of loose debris with a commercially available gas/air lance. A pavement breaker can be utilized to prepare the hole or remove any large debris. A pavement saw can also be utilized to shape the pothole if required.

If the repair is to made in concrete, it is generally advisable to coat the application area with a suitable concrete primer. The concrete primer should have a minimum penetration into the concrete of 2–5 mm and have a rapid curing rate. Any primer can be utilized which is compatible with the pavement repair materials previously described. No primer is needed for asphalt repairs.

The pavement repair material is then dispensed from the mixing chamber through the outlet chute into the repair area. For deep repairs, it may be necessary to "bulk out" the repair area by first placing a layer of clean, dry aggregate onto the application surface and then adding the pavement repair material. The "bulk out" process will increase the compressive loading capacity of the ultimate repair.

The material can be smoothed with a smoothing/leveling iron to ensure adequate coverage into all crevices and cracks. The leveling irons are preferably stored in a heated storage compartment when not in use. No compaction equipment is necessary and the material is also self leveling after being initially smoothed.

A dressing of 2 mm to 6 mm clean, dry and heated aggregate can be applied to the surface of the completed patch for enhanced traction if desired. The aggregate should be heated prior to application to the asphaltic binder material by utilizing a heated mixer drum. The aggregate drum can be heated with the gas/air lance utilized for preparing the application surface. Water can be applied to the surface of the repair material after it is in place to speed the curing time, if necessary. Water can be applied by means of a mist or spray applicator.

For repairing longitudinal cracks in concrete or asphalt pavements, the cracks should generally first be milled out using a hydraulically powered cold planar. For example, a crack is typically milled to a depth of ¾ inch to 1 inch and shall be milled out a maximum of 4–6 inches on both sides of the crack itself. After the milling of the crack has been completed, the crack is cleaned using, for example the gas/air lance. The cleaned repair area should then be coated with a suitable primer, as previously described, for concrete surfaces. No primer is required for asphalt crack repairs. The pavement repair material which has been heated in the mixing chamber is then applied to the area, for example, by using a screed box. A finish application of 2–6 mm of heated, clean dry aggregate can be applied to the surface of the binder material if desired.

An invention has been provided with several advantages. The apparatus of the invention provides a convenient means for heating a new class of roadway repair materials. The unique mixing chamber is heated by either a dry, radiant source or a liquid heat transfer source. A unique paddle arrangement on the mixing shaft provides enhanced mixing. The device is much simpler in design and more economical to manufacture than prior art devices of the same general type. The new pavement repair material which is dispensed by the apparatus does not require a separate aggregate stone mixing step, does not require compaction and is self-leveling. Old asphalt debris removed from the pothole work surface can be loaded back into the mixing chamber of the device, reheated and broken down so as to blend with the material being heated in the chamber. In this way, old asphalt materials from the work surface can be recycled and reused.

While the invention has been shown in only one of its forms, it is not thus limited but is susceptible to various changes and modifications without departing from the spirit thereof.

What is claimed is:

1. A portable apparatus for transporting heated pavement repair materials for use in repairing roadways by applying thereto a heated asphaltic/polymeric binder material or alternatively, a traditional asphaltic repair materials a heat chamber having an enclosed interior;

a mixing chamber contained within the enclosed interior of the heat chamber, the mixing chamber having an inlet for receiving pavement repair materials and an outlet for discharging mixed and heated product;

selectable and diverse heating sources located within the heat chamber for heating the material within the mixing chamber, the selectable and diverse heating sources including both a dry, radiant source operable for heating the material within the heat chamber to between 150° C. and 210° C. and a liquid heat transfer source; and wherein the dry, radiant heat source is used to heat the asphaltic/Polymeric binder material, the liquid heat transfer source being used to heat traditional asphaltic repair materials.

2. The apparatus of claim 1, wherein the dry, radiant heat source is a burner fired retort tube located in the heat chamber and at least partly surrounding the mixing chamber.

3. The apparatus of claim 2, wherein the liquid heat transfer source is a heat transfer oil located in the heat chamber and at least partly surrounding the mixing chamber, the heat transfer oil being heated by heat transferred from the burner fired retort tube.

4. The apparatus of claim 1, further comprising:

an electric immersion heater located within the heat chamber.

5. A portable apparatus for transporting heated asphaltic/polymeric binder materials for use in repairing roadways, the apparatus comprising:

a heat chamber having an enclosed interior;

a mixing chamber contained within the enclosed interior of the heat chamber, the mixing chamber having an inlet for receiving solid asphaltic/polymeric binder materials and an outlet for discharging mixed and heated pourable material, the mixing chamber being generally cylindrically shaped and having a hydraulically powered mixing shaft centrally located therein for continuous mixing of the heated pourable material; and a dry, radiant heat source located within the heat chamber for heating the material within the mixing chamber to between 150° C. and 210° C.;

wherein the dry, radiant heat source is a burner fired retort tube located in the heat chamber and at least partially surrounding the mixing chamber; and wherein the apparatus further comprises an insulated lining surrounding the interior of the heat chamber and a metallic heat shield located within the heat chamber interior for focusing radiant heat on the mixing chamber, the shield being located below the mixing chamber and burner fired retort tube and being surrounded on an outside surface thereof by the insulated lining of the heat chamber.

6. The apparatus of claim 5, wherein the hydraulically powered mixing shaft extends along a central horizontal axis of the mixing chamber and has a plurality of mixing paddle arms which extend outwardly from the shaft generally perpendicular thereto, each paddle arm terminating in a paddle head which forms a V-shaped surface generally normal to the axis of the paddle arm.

* * * * *